US006863368B2

(12) United States Patent
Sadasivan et al.

(10) Patent No.: US 6,863,368 B2
(45) Date of Patent: Mar. 8, 2005

(54) METHOD OF FORMING A COLOR FILTER

(75) Inventors: Sridhar Sadasivan, Rochester, NY (US); Ramesh Jagannathan, Rochester, NY (US); Seshadri Jagannathan, Rochester, NY (US); Rajesh V. Mehta, Rochester, NY (US); David J. Nelson, Rochester, NY (US); Glen C. Irvin, Jr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 89 days.

(21) Appl. No.: 10/460,245

(22) Filed: Jun. 12, 2003

(65) Prior Publication Data

US 2003/0210317 A1 Nov. 13, 2003

Related U.S. Application Data

(63) Continuation-in-part of application No. 10/016,054, filed on Dec. 6, 2001.

(51) Int. Cl.[7] ..... B41J 2/165; B41J 2/015

(52) U.S. Cl. ..... 347/25; 347/21

(58) Field of Search ..... 347/20, 21, 25, 347/84, 97; 427/446

(56) References Cited

U.S. PATENT DOCUMENTS 4,734,227 A 3/1988 Smith
5,545,307 A * 8/1996 Doss et al. ..... 205/122
5,639,441 A * 6/1997 Sievers et al. ..... 424/9.3
5,874,188 A 2/1999 Roberts et al.
6,050,680 A 4/2000 Moriyama et al.
6,116,718 A 9/2000 Peeters et al.
6,245,393 B1 6/2001 Thompson et al.
6,467,871 B1 * 10/2002 Moffat et al. ..... 347/21

FOREIGN PATENT DOCUMENTS

| | | |
|---|---|---|
| EP | 0317219 | 5/1989 |
| EP | 0997298 | 4/2000 |
| JP | 06126986 | 6/2001 |
| WO | WO 02/45868 A2 | 6/2002 |

OTHER PUBLICATIONS

U.S. Appl. No. 10/016,054, filed Dec. 6, 2001 in the name David J. Nelson et al.

* cited by examiner

*Primary Examiner*—Thinh Nguyen
(74) *Attorney, Agent, or Firm*—William R. Zimmerli

(57) ABSTRACT

A method of forming a color filter and a color filter are provided. The method includes providing a mixture of a color filter material and a compressed fluid; providing a substrate; providing a printhead adapted to deliver the mixture of the color filter material and the compressed fluid toward the substrate; positioning the printhead in a predetermined location relative to the substrate; and ejecting the mixture of the color filter material and the compressed fluid through the printhead toward the substrate, wherein the color filter material becomes free of the compressed fluid prior to the color filter material contacting the substrate at the predetermined location.

14 Claims, 9 Drawing Sheets

METHOD OF FORMING A COLOR FILTER

CROSS REFERENCE TO RELATED APPLICATIONS

This application is a continuation-in-part of U.S. patent application Ser. No. 10/016,054 filed Dec. 06, 2001 and assigned to the Eastman Kodak Company.

FIELD OF THE INVENTION

This invention relates generally to printing and more particularly, to printing using solvent free materials.

BACKGROUND OF THE INVENTION

Color filters and the methods used to manufacture color filters are known. Color filter producing methods include techniques that deposit color filter material onto a prepatterned substrate. These techniques include, for example, vapor deposition, spin-coating, and thermal deposition (see, for example, U.S. Pat. No. 5,874,188, issued to Roberts et al., on Feb. 23, 1999).

Other methods of manufacturing color filters involve evaporating the color filter material, using heat or ion bombardment, and then depositing the evaporated color filter material onto a substrate using a condensation process or a chemical reaction. In these manufacturing processes, the color filter material must to be thermally stable or have a thermally stable precursor that generates the color filter material on the substrate (when a chemical reaction process is used). As is known in the art, these processes are not adapted to generate patterned layers of thermally unstable color filter materials.

Typically, color filters are formed as a continuous film or and array of pixels. They can include a single color material or multiple color materials (for example, combinations of red, green, and blue; or cyan, magenta, yellow, and black). When multiple color materials are used, the color filter is typically formed using pixels in a two dimensional array. Conventional color filter materials are typically composed of organic and organometallic pigments, semiconductors, ceramics, and combinations thereof.

Inkjet printing systems are commonly used to create high-resolution patterns on a substrate. In a typical inkjet printing system, ink droplets are ejected from a nozzle towards a recording element or medium to produce an image on the medium.

When used to create a color filter, the ink composition, or recording liquid, ejected by the inkjet printing system comprises a color filter material, such as a dye or pigment or polymer, and a large amount of solvent, or carrier liquid. Typically, the solvent is made up of water, an organic material such as a monohydric alcohol, a polyhydric alcohol or mixtures thereof. The ink composition usually includes additives designed to preserve pixel integrity after the droplet is deposited on the recording element, or substrate, due to the high concentrations of solvents in conventional color filter ink formulations. Additive materials may include surfactants, humectants, biocides, rheology modifiers, sequestrants, pH adjusters, and penetrants, etc.

U.S. Pat. No. 6,245,393 B1, issued to Thompson et al., on Jun. 12, 2001, discloses a method of making a multicolor display device. The device includes a transparent substrate and a fluorescent dye deposited in a dye layer on the substrate using inkjet printing. This method is disadvantaged because the ink compositions, which include the color filter material, have high solvent concentrations which enables the ejection of the ink composition using conventional inkjet printers. As such, processing steps devoted to the removal of the solvent(s) are required. Additionally, the color filter materials used will not always dissolve or solubilize in commonly available solvents. This can necessitate the use of exotic solvents that are environmentally harmful and/or expensive.

Other technologies that deposit a functional material onto a receiver using gaseous propellants are known. For example, Peeters et al., in U.S. Pat. No. 6,116,718, issued Sep. 12, 2000, discloses a print head for use in a marking apparatus in which a propellant gas is passed through a channel, the marking material is introduced controllably into the propellant stream to form a ballistic aerosol for propelling non-colloidal, solid or semi-solid particulate or a liquid, toward a receiver with sufficient kinetic energy to fuse the marking material to the receiver. There is a problem with this technology in that the marking material and propellant stream are two different entities and the propellant is used to impart kinetic energy to the marking material. When the marking material is added into the propellant stream in the channel, a non-colloidal ballistic aerosol is formed prior to exiting the print head. This non-colloidal ballistic aerosol, which is a combination of the marking material and the propellant, is not thermodynamically stable/metastable. As such, the marking material is prone to settling in the propellant stream which, in turn, can cause marking material agglomeration, leading to nozzle obstruction and poor control over marking material deposition.

Technologies that use supercritical fluid solvents to create thin films are also known. For example, R. D. Smith in U.S. Pat. No. 4,734,227, issued Mar. 29, 1988, discloses a method of depositing solid films or creating fine powders through the dissolution of a solid material into a supercritical fluid solution and then rapidly expanding the solution to create particles of the marking material in the form of fine powders or long thin fibers, which may be used to make films. There is a problem with this method in that the free-jet expansion of the supercritical fluid solution results in a non-collimated/defocused spray that cannot be used to create high resolution patterns on a receiver. Further, defocusing leads to losses of the marking material.

SUMMARY OF THE INVENTION

According to one feature of the present invention, a method of forming a color filter includes providing a mixture of a color filter material and a compressed fluid; providing a substrate; providing a printhead adapted to deliver the mixture of the color filter material and the compressed fluid toward the substrate; positioning the printhead in a predetermined location relative to the substrate; and ejecting the mixture of the color filter material and the compressed fluid through the printhead toward the substrate, wherein the color filter material becomes free of the compressed fluid prior to the color filter material contacting the substrate at the predetermined location.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
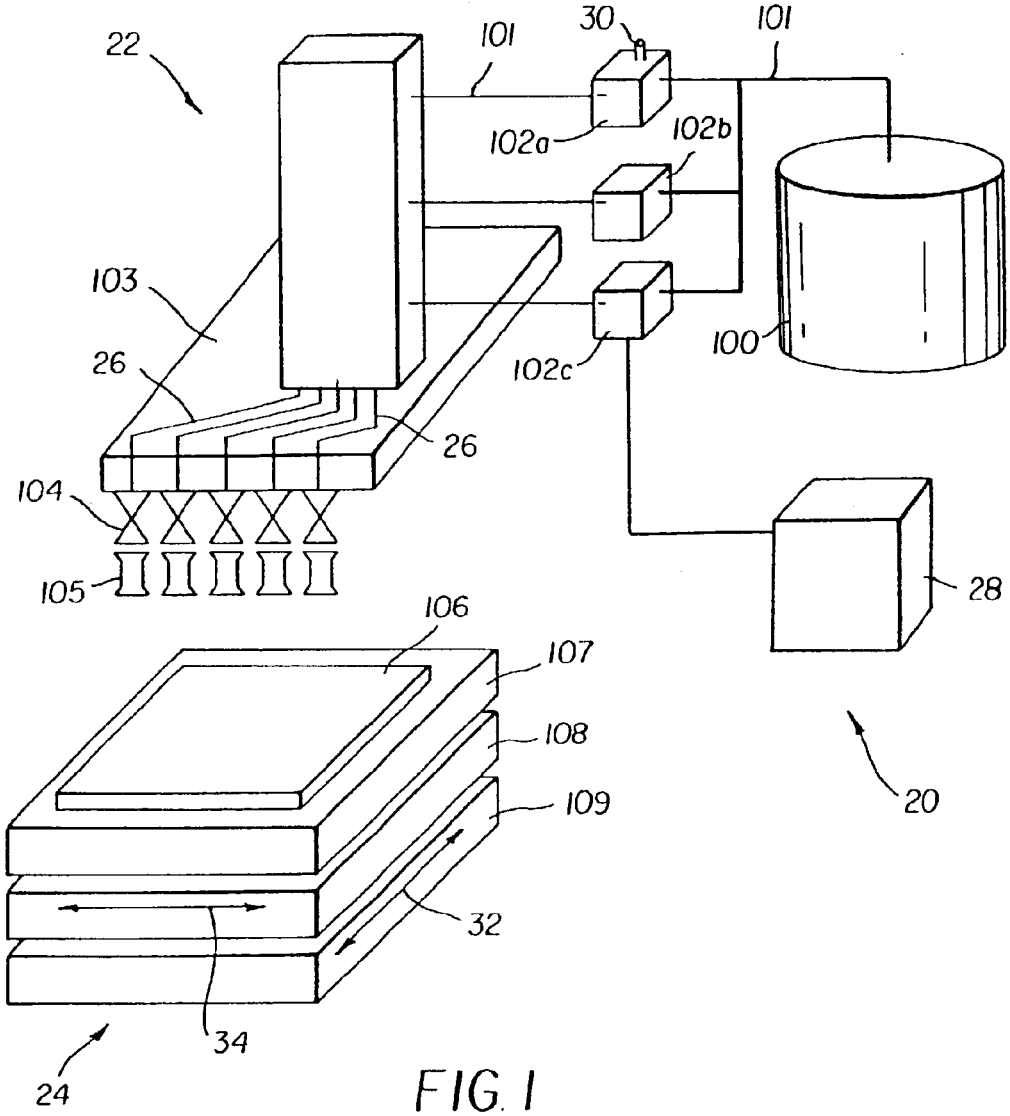
FIG. 1 is a schematic view of a first embodiment made in accordance with the present invention.

The present description will be directed in particular to elements forming part of, or cooperating more directly with, apparatus in accordance with the present invention. It is to be understood that elements not specifically shown or described may take various forms well known to those skilled in the art. Additionally, materials identified as suitable for various facets of the invention, for example, color filter materials, solvents, equipment, etc. are to be treated as exemplary, and are not intended to limit the scope of the invention in any manner.

Referring to FIGS. 1–6, a printing apparatus 20 is shown. The printing apparatus 20 includes a color filter material delivery system 22 and a receiver retaining device 24. In operation, at least one of the color filter material delivery system 22 (for example, a printhead 103) and the receiver retaining device 24 are move relative to one another such that a predetermined location of receiver 106 can be printed with a color filter material. The amount of color filter material printed at each receiver location can be controlled using, for example, a controller to appropriately actuate an actuating mechanism 104; varying concentration levels in a formulation reservoir 102*a*, 102*b*, 102*c*; etc.

The color filter material delivery system 22 has a pressurized source of a thermodynamically stable mixture of a fluid and the color filter material, herein after referred to as a formulation reservoir(s) 102*a*, 102*b*, 102*c*, connected in fluid communication to a delivery path 26 at least partially formed in/on the printhead 103. The printhead 103 includes a discharge device 105 positioned along the delivery path 26 configured (as discussed below) to produce a shaped beam of the color filter material. An actuating mechanism 104 is also positioned along the delivery path 26 and is operable to control delivery of the color filter material though the printhead 103.

The formulation reservoir(s) 102*a*, 102*b*, 102*c* is connected in fluid communication to a source of fluid 100 and a source of color filter material 28 (shown with reference to formulation reservoir 102*c* in FIG. 1). Alternatively, the color filter material can be added to the formulation reservoir(s) 102*a*, 102*b*, 102*c* through a port 30 (shown with reference to formulation reservoir 102*a* in FIG. 1).

One formulation reservoir 102*a*, 102*b*, or 102*c* can be used in applications where a single material is printed. Alternatively, multiple formulation reservoirs 102*a*, 102*b*, or 102*c* can be used in applications where multiple materials are printed. When multiple formulation reservoirs 102*a*, 102*b*, 102*c* are used, each formulation reservoir 102*a*, 102*b*, 102*c* is connected in fluid communication through delivery path 26 to a dedicated discharge device(s) 105. One example of this includes dedicating a first row of discharge devices 105 to formulation reservoir 102*a*; a second row of discharge devices 105 to formulation reservoir 102*b*; and a third row of discharge devices to formulation reservoir 102*c*. Other formulation reservoir and discharge device combinations exist depending on the particular printing application.

A discussion of illustrative embodiments follows with like components being described using like reference symbols. As used herein, the compressed fluid refers to fluids with a density greater than 0.1 grams/cc. It is also recognized that other color filter materials can be used with the apparatus described herein.

Referring to FIG. 1, a first embodiment is shown. The printhead 103 which includes at least one discharge device 105 and at least one actuating mechanism 104 remains stationary during operation. However, the printhead 103 can maintain a limited movement capability as is required to dither the image (typically from one to two pixels in length). A receiver 106 positioned on a receiver retaining device 24 moves in a first direction 32 and a second direction 34. Typically, the second direction 34 is substantially perpendicular to the first direction 32. The two directional motion of receiver 106 can be achieved by using a receiver retaining device 24 having a first motorized translation stage 108 positioned over a second motorized translation stage 109.

In this embodiment, the printhead 103 can be connected to the formulation reservoir(s) 102*a*, 102*b*, 102*c* using essentially rigid, inflexible tubing 101. As the color filter material delivery system is typically under high pressure from the compressed fluid source 100, through tubing 101 and the formulation reservoirs 102*a*, 102*b*, 102*c*, to the actuating mechanism 104, the tubing 101 can have an increased wall thickness which helps to maintain a constant pressure through out the color filter material delivery system 22.

Figure 2:
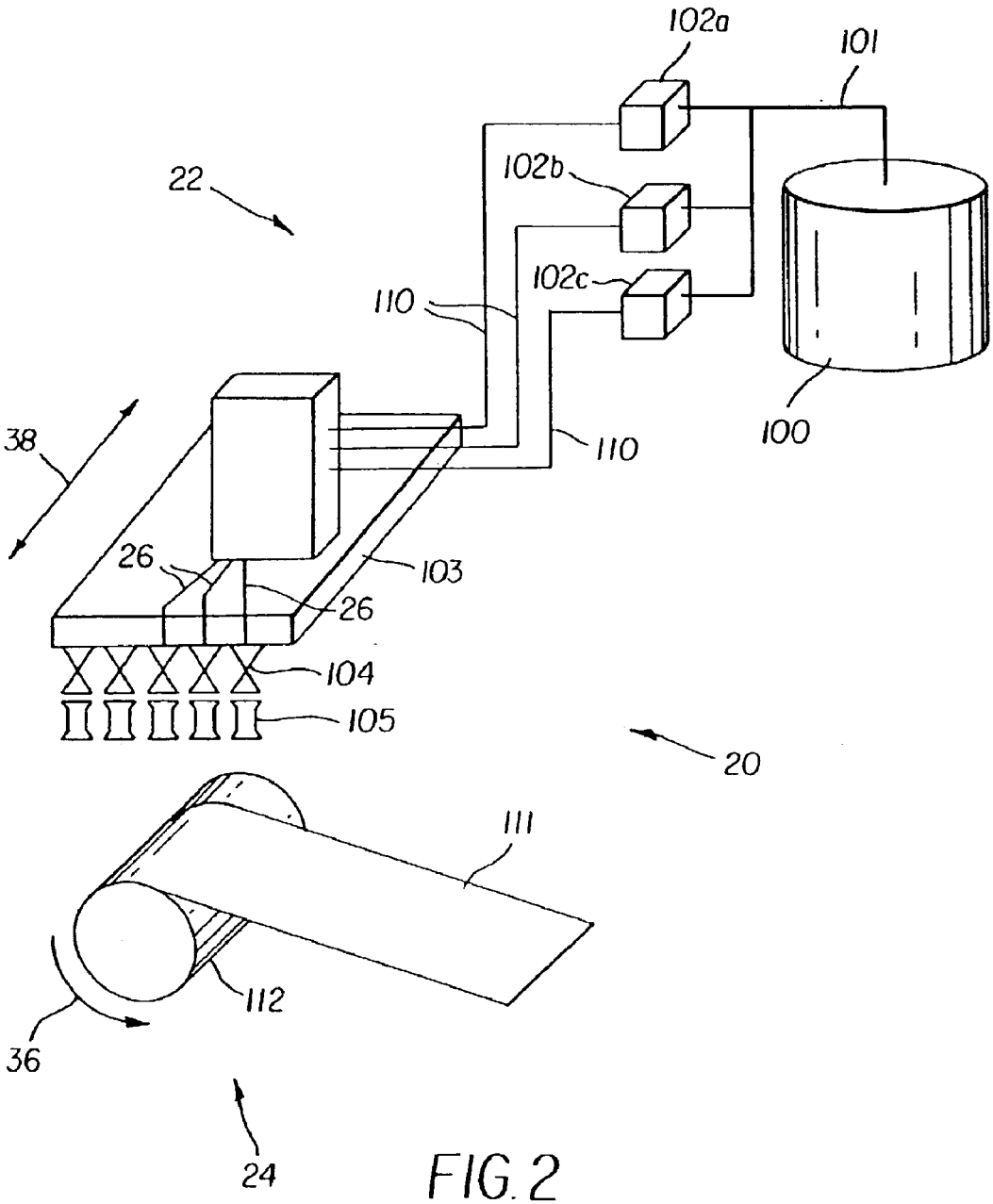
FIGS. 2–5 are schematic views of alternative embodiments made in accordance with the present invention.

Referring to FIG. 2, a second embodiment is shown. In this embodiment the receiver retaining device 24 is a roller 112 that provides one direction of motion 36 for a receiver 11 while the printhead 103 translates in a second direction 38. Rigid tubing 101 connects the compressed fluid source 100 to the formulation reservoir(s) 102*a*, 102*b*, 102*c*. However, the printhead 103 is connected to the formulation reservoir(s) 102*a*, 102*b*, 102*c* by a flexible high pressure tube(s) 110. A suitable flexible hose can be, for example, a Titeflex extra high pressure hose P/N R157-3 (0.110 inside diameter, 4000 psi rated with a 2 in bend radius) commercially available from Kord Industrial, Wixom, Mich. The compressed fluid source 100 is remotely positioned relative to the printhead 103.

In a multiple material printing operation, each material is applied in a controlled manner through the actuating mechanisms 104 and discharge devices 105 of printhead 103 as the printhead 103 translates in second direction 38. The printhead 103 has at least one discharge device 105 dedicated to each material. Then, the roller 112 increments the flexible receiver 111 in the first direction 36 by a small amount. The printhead 103 then translates back along second direction 38 printing the next line. For adequate printhead position accuracy, the printing apparatus 20 typically includes a feedback signal, often created, for example, by a linear optical encoder (not shown).

Figure 3:
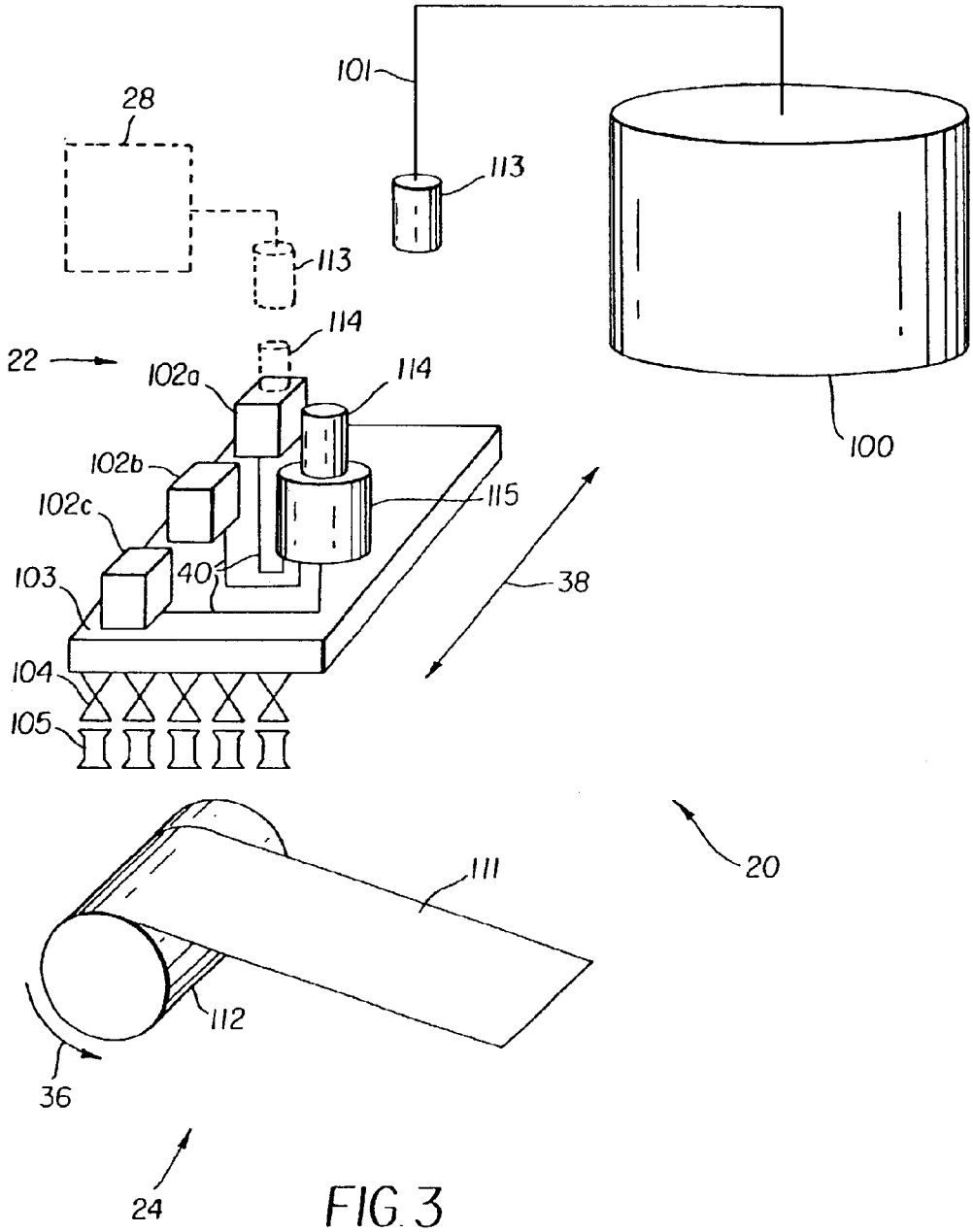

Referring to FIG. 3, a third embodiment is shown. In this embodiment, the color filter material delivery system 22 includes a compressed fluid source 115 positioned on the printhead 103. The compressed fluid source 115 is in fluid communication with the formulation reservoir(s) 102*a*, 102*b*, 102*c* through delivery path(s) 40 located on or in the printhead 103. The formulation reservoir(s) 102*a*, 102*b*, 102*c* are connected in fluid communication with the discharge device(s) 105 through delivery path(s) 26 positioned on or in the printhead 103.

The compressed fluid source 100 is connected to a docking station 113 which mates with a recharging port 114 of the compressed fluid source 115 located on the printhead 103. This allows the compressed fluid contained in the compressed fluid source 115 located on the printhead 103 to be replenished as is required during a printing operation. Recharging can occur in a variety of situations, for example, recharging can occur when a predetermined remaining pressure or weight of the compressed fluid source 115 is detected; after a known volume of compressed fluid has been discharged; at any convenient time during the printing process; etc. The docking station 113 is supplied with compressed fluid from a compressed fluid source 100 through rigid tubing 101. However, flexible tubing 110 can be used.

The source or color filter material 28 can also be connected to a docking station 113 which mates with a recharging port 114 of the formulation reservoir(s) 102*a*, 102*b*, 102*c* (shown in phantom in FIG. 3). This allows the color filter material contained in the formulation reservoir(s) 102*a*, 102*b*, 102*c* located on the printhead 103 to be replenished as is required during a printing operation. Depending on the number of formulation reservoir(s) 102*a*, 102*b*, 102*c*, multiple docking stations 113 and recharging ports 114 can be included.

Figure 4:
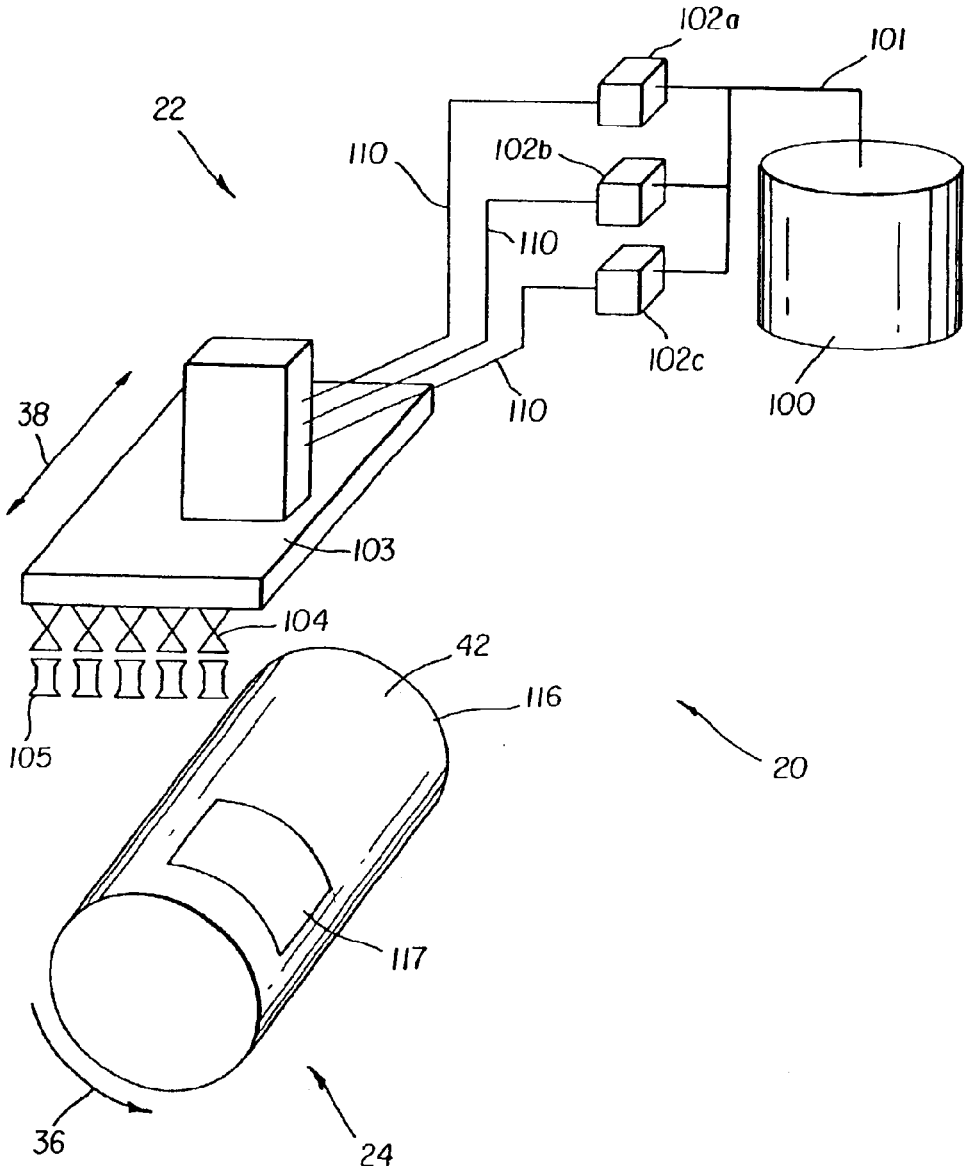

Referring to FIG. 4, the receiver retaining device 24 includes a spinning drum 113. Typically, the spinning drum 116 provides faster translations than are possible with the feed roller 112 (shown in FIG. 2) which increases the overall printing speed of the printing apparatus 20. The compressed fluid source 100, rigid tubing 101, formulation reservoir(s) 102*a*, 102*b*, 102*c*, flexible tubing 110, printhead 103, actuating mechanisms 104 and discharge devices 105 operate as described with reference to FIG. 2.

In operation, the spinning drum 116 typically completes at least on revolution in the first direction 36 prior to translating the printhead 103 in the second direction 38. As such, the printhead 103 does not have to translate back and forth along the second direction 38 during the printing operation. In this embodiment, it is possible to maintain a high rate of relative motion between the flexible receiver 117 and the printhead 103 because the printhead 103 typically makes a single pass along second direction 38 during printing.

Figure 5:
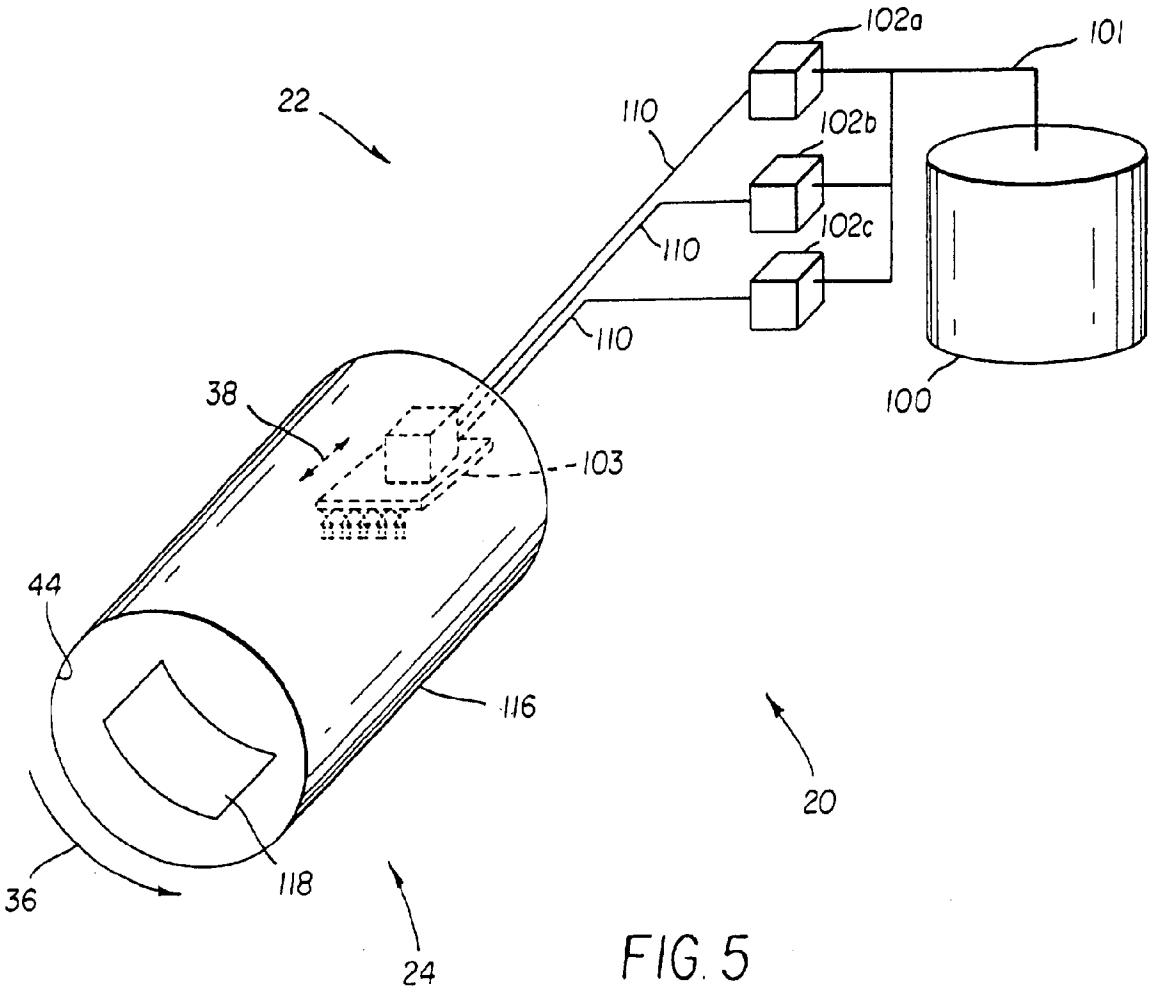
Figure 6A:
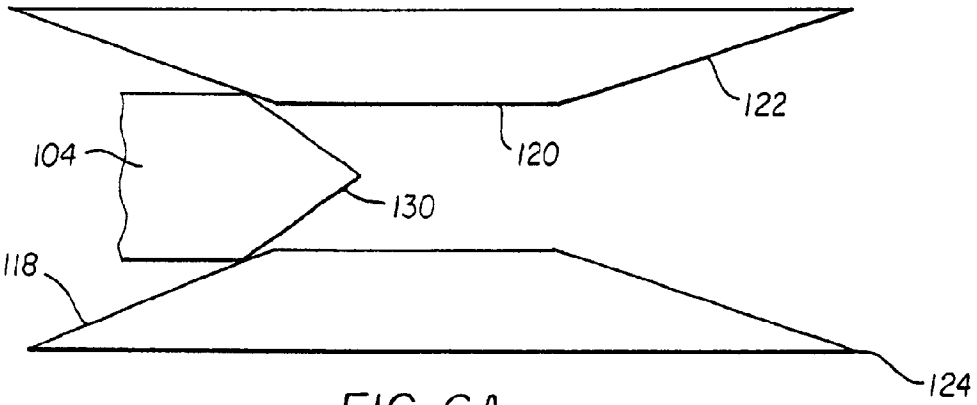
FIGS. 6A–7B are schematic views of a discharge device and an actuating mechanism made in accordance with the present invention.
Figure 6B:
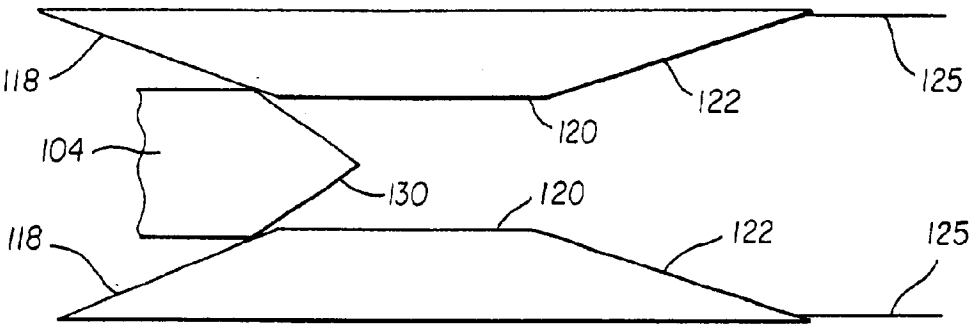
Figure 7A:
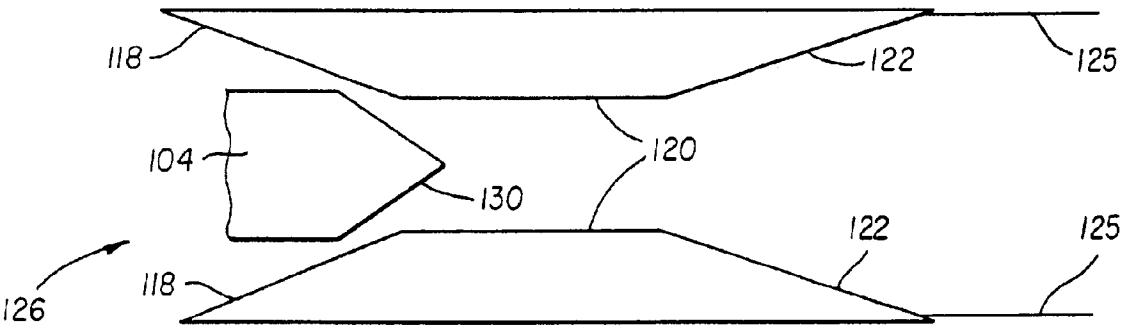
Figure 7B:
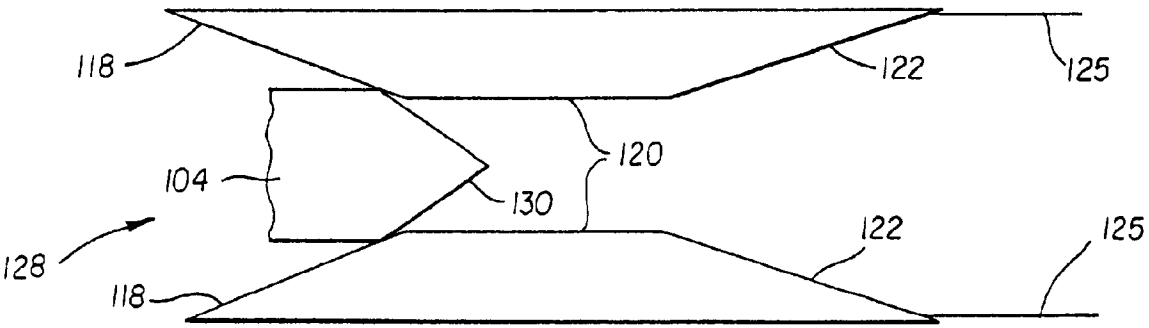

In FIG. 4, the receiver 117 is positioned on an exterior surface 42 of the drum 116. Referring to FIG. 5, a receiver 118 is positioned on an interior surface 44 of the drum 116. In this embodiment, the printhead 103 translates slowly along the length of the interior of the drum 116 in the second direction 38.

Alternatively, as the movement of the printhead 103 in the second direction 38 is typically slow (as compared to the speed of rotation of the drum 116), the color filter material delivery system 22 described with reference to FIG. 3 can be substituted for the color filter material delivery system 22 described with reference to FIGS.4 and 5. Additionally, the drum 116 can also be translated in the second direction 38 while the printhead 103 remains stationary for some applications. Again, this is because of the typically slow movement in the second direction as compared to the speed of rotation of the drum 116. In this application, the color filter material delivery system described with reference to FIG. 1 can be substituted for the color filter material delivery system 22 described with reference to FIGS. 4 and 5.

These embodiments are described as examples of possible ways of achieving desired relative movements of the printhead 103 and the receiver 106, 117, 118. However, it is recognized that there are other possible ways to achieve relative motion of the print head 103 and the receiver 106, 117, 118.

Referring to FIGS. 6A–7B, the discharge device 105 of the print head 103 includes a first variable area section 118 followed by a first constant area section 120. A second variable area section 122 diverges from constant area section 120 to an end 124 of discharge device 105. The first variable area section 118 converges to the first constant area section 120. The first constant area section 118 has a diameter substantially equivalent to the exit diameter of the first variable area section 120. Alternatively, discharge device 105 can also include a second constant area section 125 positioned after the variable area section 122. Second constant area section 125 has a diameter substantially equivalent to the exit diameter of the variable area section 122. Discharge devices 105 of this type are commercially available from Moog, East Aurora, N.Y.; Vindum Engineering Inc., San Ramon, Calif., etc.

The actuating mechanism 104 is positioned within discharge device 105 and moveable between an open position 126 and a closed position 128 and has a sealing mechanism 130. In closed position 128, the sealing mechanism 130 in the actuating mechanism 104 contacts constant area section 120 preventing the discharge of the thermodynamically stable mixture of compressed fluid and color filter material. In open position 126, the thermodynamically stable mixture of compressed fluid and color filter material is permitted to exit discharge device 105.

The actuating mechanism 104 can also be positioned in various partially opened positions depending on the particular printing application, the amount of thermodynamically stable mixture of fluid and color filter material desired, etc. Alternatively, actuating mechanism 104 can be a solenoid valve having an open and closed position. When actuating mechanism 104 is a solenoid valve, it is preferable to also include an additional position controllable actuating mechanism to control the mass flow rate of the thermodynamically stable mixture of fluid and color filter material.

In a preferred embodiment of discharge device 105, the diameter of the first constant area section 120 of the discharge device 105 ranges from about 20 microns to about 2,000 microns. In a more preferred embodiment, the diameter of the first constant area section 120 of the discharge device 105 ranges from about 10 microns to about 20 microns. Additionally, first constant area section 120 has a predetermined length from about 0.1 to about 10 times the diameter of first constant area section 120 depending on the printing application. Sealing mechanism 130 can be conical in shape, disk shaped, etc.

Referring back to FIGS. 1–5, the color filter material delivery system 22 takes a chosen solvent and/or predetermined color filter materials to a compressed fluid state, makes a solution and/or dispersion of a predetermined color filter material or combination of color filter materials in the chosen compressed fluid, and delivers the color filter materials as a collimated and/or focused beam onto a receiver 106 in a controlled manner. In this context, the chosen materials taken to a compressed fluid state are gases at ambient pressure and temperature. Ambient conditions are preferably defined as temperature in the range from −100 to +100° C., and pressure in the range from $1\times10^{-8-1000}$ atm for this application.

A compressed fluid carrier, contained in the compressed fluid source 100, is any material that dissolves/solubilizes/disperses a color filter material. The compressed fluid source 100 delivers the compressed fluid carrier at predetermined conditions of pressure, temperature, and flow rate as a compressed fluid, or a compressed liquid. Compressed fluids comprise supercritical fluids, compressed liquids, and/or compressed gasses. Compressed fluids that are above their critical point, as defined by a critical temperature and a critical pressure, are known as supercritical fluids. The critical temperature and critical pressure typically define a thermodynamic state in which a fluid or a material becomes supercritical and exhibits gas like and liquid like properties. Compressed fluids that are at sufficiently high temperatures and pressures below their critical point are known as compressed liquids. Compressed fluids that are at sufficiently high pressures and temperatures below their critical point are known as compressed gasses. Compressed fluids that exist as gases at ambient conditions find application here because of their unique ability to solubilize and/or disperse color filter materials of interest when in their compressed fluid state.

Fluid carriers include, but are not limited to, carbon dioxide, nitrous oxide, ammonia, xenon, ethane, ethylene, propane, propylene, butane, isobutane, chlorotrifluoromethane, monofluoromethane, sulphur hexafluoride and mixtures thereof. In a preferred embodiment, carbon dioxide is generally preferred in many applications, due its characteristics, such as low cost, wide availability, etc.

The formulation reservoir(s) 102*a*, 102*b*, 102*c* in FIG. 1 is utilized to dissolve and/or disperse predetermined color filter materials in compressed fluids with or without dispersants and/or surfactants, at desired formulation conditions of temperature, pressure, volume, and concentration. The combination of color filter materials and compressed fluid is typically referred to as a mixture, formulation, etc.

The formulation reservoir(s) 102*a*, 102*b*, 102*c* in FIG. 1 can be made out of any suitable materials that can safely operate at the formulation conditions. An operating range from 0.001 atmosphere ($1.013\times10^2$ Pa) to 1000 atmospheres ($1.013\times10^8$ Pa) in pressure and from −25 degrees Centigrade to 1000 degrees Centigrade is generally preferred. Typically, the preferred materials include various grades of high pressure stainless steel. However, it is possible to use other materials if the specific deposition or etching application dictates less extreme conditions of temperature and/or pressure.

The formulation reservoir(s) 102*a*, 102*b*, 102*c* in FIG. 1 should be adequately controlled with respect to the operating conditions (pressure, temperature, and volume). The solubility/dispersibility of color filter materials depends upon the conditions within the formulation reservoir(s) 102*a*, 102*b*, 102*c*. As such, small changes in the operating conditions within the formulation reservoir(s) 102*a*, 102*b*, 102*c* can have undesired effects on color filter material solubility/dispensability.

Additionally, any suitable surfactant and/or dispersant material that is capable of solubilizing/dispersing the color filter materials in the compressed fluid for a specific application can be incorporated into the mixture of color filter material and compressed fluid. Such materials include, but are not limited to, fluorinated polymers such as perfluoropolyether, siloxane compounds, etc.

The color filter materials can be controllably introduced into the formulation reservoir(s) 102*a*, 102*b*, 102*c*. The compressed fluid is also controllably introduced into the formulation reservoir(s) 102*a*, 102*b*, 102*c*. The contents of the formulation reservoir(s) 102*a*, 102*b*, 102*c* are suitably mixed, using a mixing device to ensure intimate contact between the predetermined imaging color filter materials and compressed fluid. As the mixing process proceeds, color filter materials are dissolved or dispersed within the compressed fluid. The process of dissolution/dispersion, including the amount of color filter materials and the rate at which the mixing proceeds, depends upon the color filter materials itself, the particle size and particle size distribution of the color filter material (if the color filter material is a solid), the compressed fluid used, the temperature, and the pressure within the formulation reservoir(s) 102*a*, 102*b*, 102*c*. When the mixing process is complete, the mixture or formulation of color filter materials and compressed fluid is thermodynamically stable/metastable, in that the color filter materials are dissolved or dispersed within the compressed fluid in such a fashion as to be indefinitely contained in the same state as long as the temperature and pressure within the formulation chamber are maintained constant. This state is distinguished from other physical mixtures in that there is no settling, precipitation, and/or agglomeration of color filter material particles within the formulation chamber, unless the thermodynamic conditions of temperature and pressure within the reservoir are changed. As such, the color filter material and compressed fluid mixtures or formulations of the present invention are said to be thermodynamically stable/metastable. This thermodynamically stable/metastable mixture or formulation is controllably released from the formulation reservoir(s) 102*a*, 102*b*, 102*c* through the discharge device 105 and actuating mechanism 104.

During the discharge process, the color filter materials are precipitated from the compressed fluid as the temperature and/or pressure conditions change. The precipitated color filter materials are preferably directed towards a receiver 106 by the discharge device 105 through the actuating mechanism 104 as a focussed and/or collimated beam. The invention can also be practiced with a non-collimated or divergent beam provided that the diameter of first constant area section 120 and printhead 103 to receiver 106 distance are appropriately small. For example, in a discharge device 105 having a 10 um first constant area section 120 diameter, the beam can be allowed to diverge before impinging receiver 106 in order to produce a printed dot size of about 60 um (a common printed dot size for many printing applications). Discharge device 105 diameters of these sizes can be created with modem manufacturing techniques such as focused ion beam machining, MEMS processes, etc.

The particle size of the color filter materials deposited on the receiver 105 is typically in the range from 100 nanometers to 1000 nanometers. The particle size distribution may be controlled to be uniform by controlling the rate of change of temperature and/or pressure in the discharge device 105, the location of the receiver 106 relative to the discharge device 105, and the ambient conditions outside of the discharge device 105.

The print head 103 is also designed to appropriately change the temperature and pressure of the formulation to permit a controlled precipitation and/or aggregation of the color filter materials. As the pressure is typically stepped down in stages, the formulation fluid flow is self-energized. Subsequent changes to the formulation conditions (a change in pressure, a change in temperature, etc.) result in the precipitation and/or aggregation of the color filter material, coupled with an evaporation of the compressed fluid. The resulting precipitated and/or aggregated color filter material deposits on the receiver 106 in a precise and accurate fashion. Evaporation of the supercritical fluid can occur in a region located outside of the discharge device 105. Alternatively, evaporation of the compressed fluid can begin within the discharge device 105 and continue in the region located outside the discharge device 105. Alternatively, evaporation can occur within the discharge device 105.

A beam (stream, etc.) of the color filter material and the compressed fluid is formed as the formulation moves through the discharge device 105. When the size of the precipitated and/or aggregated color filter materials is substantially equal to an exit diameter of the discharge device 105, the precipitated and/or aggregated color filter materials have been collimated by the discharge device 105. When the sizes of the precipitated and/or aggregated color filter materials are less than the exit diameter of the discharge device 105, the precipitated and/or aggregated color filter materials have been focused by the discharge device 105.

The receiver 106 is positioned along the path such that the precipitated and/or aggregated predetermined color filter materials are deposited on the receiver 106. The distance of the receiver 106 from the discharge device 105 is chosen such that the compressed fluid evaporates prior to reaching the receiver 106. Hence, there is no need for a subsequent receiver drying processes. Alternatively, the receiver 106 can be electrically or electrostatically charged, such that the location of the color filter material in the receiver 106 can be controlled.

It is also desirable to control the velocity with which individual particles of the color filter material are ejected from the discharge device 105. As there is a sizable pressure drop from within the printhead 103 to the operating environment, the pressure differential converts the potential energy of the printhead 103 into kinetic energy that propels the color filter material particles onto the receiver 106. The velocity of these particles can be controlled by suitable discharge device 105 with an actuating mechanism 104. Discharge device 105 design and location relative to the receiver 106 also determine the pattern of color filter material deposition.

The temperature of the discharge device 105 can also be controlled. Discharge device temperature control may be controlled, as required, by specific applications to ensure that the opening in the discharge device 105 maintains the desired fluid flow characteristics.

The receiver 106 can be any solid material, including an organic, an inorganic, a metallo-organic, a metallic, an alloy, a ceramic, a synthetic and/or natural polymeric, a gel, a glass, or a composite material. The receiver 106 can be porous or non-porous. Additionally, the receiver 106 can have more than one layer. The receiver 106 can be a sheet of predetermined size. Alternately, the receiver 106 can be a continuous web.

Referring back to FIGS. 1–5, in addition to multiple color filter material printing, additional color filter material(s) can be dispensed through printhead 103 in order to improve color gamut, provide protective overcoats, etc. When additional color filter materials are included check valves and printhead design help to reduce color filter material contamination.

Figure 8:
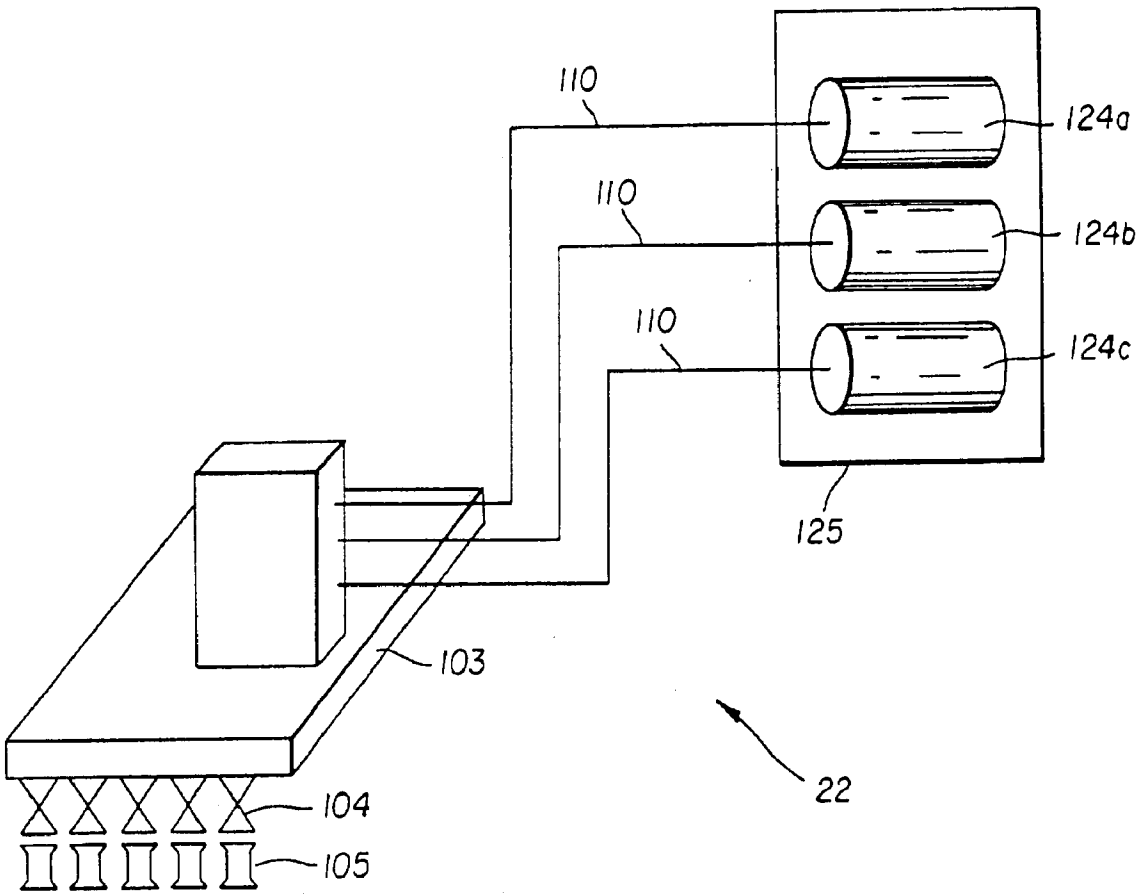
FIGS. 8 and 9 are schematic views of alternative embodiments made in accordance with the present invention.

Referring to FIG. 8, a premixed tank(s) 124*a*, 124*b*, 124*c*, containing premixed predetermined color filter materials and the compressed fluid are connected in fluid communication through tubing 110 to printhead 103. The premixed tank(s) 124*a*, 124*b*, 124*c* can be supplied and replaced either as a set 125, or independently in applications where the contents of one tank are likely to be consumed more quickly than the contents of other tanks. The size of the premixed tank(s) 124*a*, 124*b*, 124*c*, can be varied depending on anticipated usage of the contents. The premixed tank(s) 124*a*, 124*b*, 124*c* are connected to the discharge devices 105 through delivery paths 26. When multiple material printing is desired, the discharge devices 105 and delivery paths 26 are dedicated to a particular premixed tank(s) 124*a*, 124*b*, 124*c*.

Figure 9A:
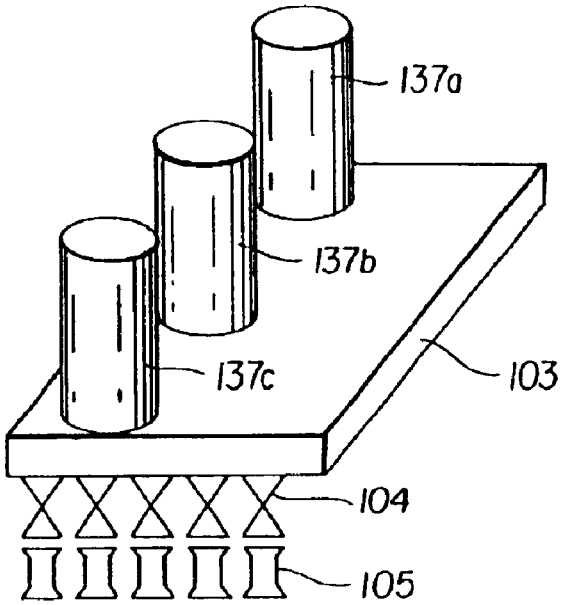
Figure 9B:
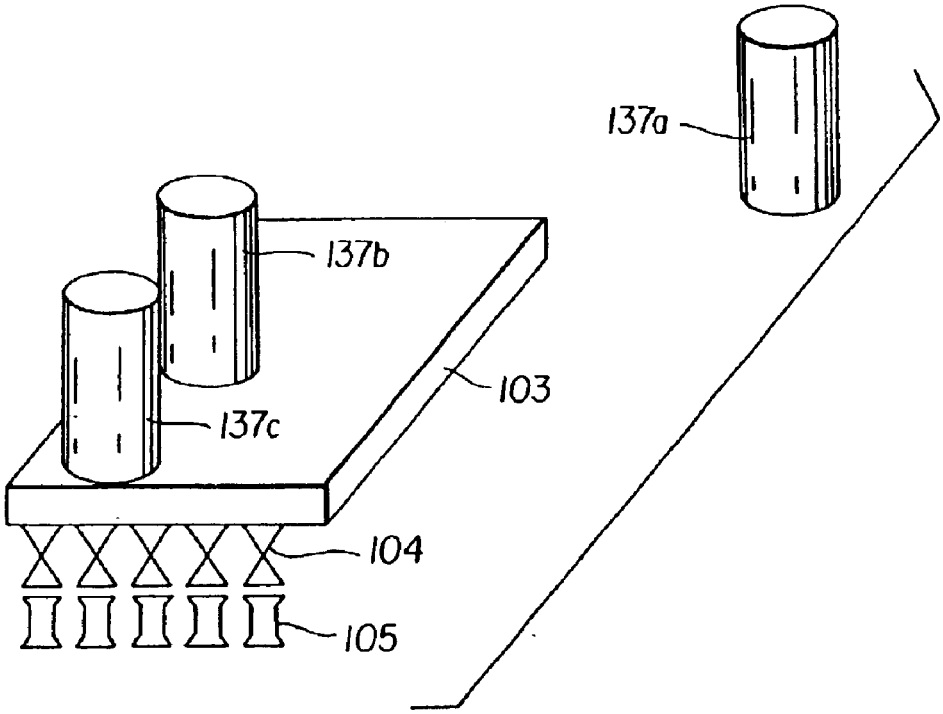

Referring to FIGS. 9A and 9B, another embodiment describing premixed canisters containing predetermined color filter materials is shown. Premixed canister(s) 137*a*, 137*b*, 137*c* is positioned on the printhead 103. When replacement is necessary, premixed canister 137*a*, 137*b*, 137*c* can be removed from the printhead 103 and replaced with another premixed canister(s) 137*a*, 137*b*, 137*c*.

General Architecture of a Color Filter

The general architecture of a color filter made in accordance with the present invention will now be described. The color filter can be a continuous film type or a pixellated array type. Additionally, either type of color filter can include one or a plurality of color filter materials.

Substrate

The substrate used with the invention can be any solid material, including an organic, an inorganic, a metallo-organic, a metallic, an alloy, a ceramic, a synthetic and/or natural polymeric, a gel, a glass, or a composite material. The substrate can also have more than one layer. For example, when the color filter is of the pixellated array type, the substrate can include a pre-patterned photoresist layer containing selected openings over the pixel array. After depositing the color filter material, the pre-patterned photoresist layer can be removed leaving the color filter material (s) in the opening position(s) over the pixel array. The photoresist layer can be created in any known manner.

Materials

The color filter material(s) can be any material delivered to a substrate, to create a pattern on the substrate using deposition, etching, or other processes involving placement of a color filter material on a substrate. The color filter material(s) can be selected from species that are ionic and/or molecular of the types such as organic, inorganic, metallo-organic, polymeric, oligomeric, metallic, alloy, ceramic, a synthetic and/or natural polymer, and a composite material.

For example, color filter materials which are useful in the invention include, but are not limited to, the following: phthalocyanines, such as Pigment Blue 15, nickel phthalocyanine, chloroaluminum phthalocyanine, hydroxy aluminum phthalocyanine, vanadyl phthalocyanine, titanyl phthalocyanine, and titanyl tetrafluorophthalocyanine; isoindolinones, such as Pigment Yellow 110 and Pigment Yellow 173; isoindolines, such as Pigment Yellow 139 and Pigment Yellow 185; benzimidazolones, such as Pigment Yellow 151, Pigment Yellow 154, Pigment Yellow 175, Pigment Yellow 194, Pigment Orange 36, Pigment Orange 62, Pigment Red 175, and Pigment Red 208; quinophthalones, such as Pigment Yellow 138; quinacridones, such as Pigment Red 122, Pigment Red 202, and Pigment Violet 19; perylenes, such as Pigment Red 123, Pigment Red 149, Pigment 179, Pigment Red 224, and Pigment Violet 29; dioxazines, such as Pigment Violet 23; thioindigos, such as Pigment Red 88, and Pigment Violet 38; epindolidiones, such as 2,8-difluoroepindolidione; anthanthrones, such as Pigment Red 168; isoviolanthrones, such as isoviolanthrone; indanthrones, such as Pigment Blue 60; imidazobenzimidazolones, such as Pigment Yellow 192; pyrazoloquinazolones, such as Pigment Orange 67; iketopyrrolopyrroles, such as Pigment Red 254, Irgazin DPP RubinTR, Cromophtal DPP OrangeTR; Chromophtal DPP Flame Red FP (all of Ciba-Geigy); and bisaminoanthrones, such as Pigment Red 177.

The color filter material(s) can be a solid or a liquid. Additionally, the color filter material(s) can be an organic molecule, a polymer molecule, a metallo-organic molecule, an inorganic molecule, an organic nanoparticle, a polymer nanoparticle, a metallo-organic nanoparticle, an inorganic nanoparticle, an organic microparticles, a polymer microparticle, a metallo-organic microparticle, an inorganic microparticle, and/or composites of these materials, etc. Depending on the specific application, it can be desirable to have a polymer-inorganic nanoparticle composite forming the color filter material layer.

The color filter material(s) can be functionalized to dissolve, disperse and/or solubilize the color filter material (s) in the compressed fluid. The functionalization may be performed by attaching fluorocarbons, siloxane, or hydrocarbon functional groups to the color filter material.

After suitable mixing with the compressed fluid, the color filter material is uniformly distributed within a thermodynamically stable/metastable mixture (either a dispersion or a solution) with the compressed fluid (commonly referred to as the formulation). The formulation may also contain a dispersant and or a surfactant to help solubilize and/or disperse the color filter material. The dispersant and/or surfactant can be selected from any group that will have appropriate solubility in the compressed fluid medium as well as have interactions with the color filter material so that the color filter material can be solubilized. Such materials include, but are not limited to, fluorinated polymers such as perfluoropolyether, siloxane compounds, etc.

The formulation is maintained at a temperature and a pressure suitable for the color filter material and the compressed fluid used in a particular application. A preferred range of formulation conditions includes a temperature in the range of 0 to 100° C. and/or a pressure in the range from $1\times10^{-2}$ to 400 atm.

Operation

Example color filter forming processes will now be described.

The color filter forming process begins with providing a mixture of a color filter material and a compressed fluid known as a formulation and described above. A substrate is provided. The substrate can be provided at ambient conditions. Alternatively, the substrate can be located, for example, in a partially (or completely) controlled environment. In this situation, the printhead is adapted to deliver the mixture of the color filter material and the compressed fluid toward the substrate in the partially controlled environment. This can be accomplished, for example, by locating the printhead in the partially (or completely) controlled environment and using tubing to connect the printhead to the formulation reservoir(s).

The printhead is then positioned (using a controller, for example) in a predetermined location relative to the substrate and the mixture of the color filter material and the compressed fluid is ejected through the printhead toward the substrate. The color filter material becomes free of the compressed fluid (through evaporation of the compressed fluid) prior to the color filter material contacting the substrate at the predetermined location.

When the forming process includes multiple substrate locations, the predetermined location, described above, can be termed a first predetermined location. The printhead can then (if desired) be positioned at a second predetermined location relative to the substrate. The second predetermined location can be distinct and different from the first predetermined location mentioned above. Alternatively, the second predetermined location can overlap the first predetermined location either partially or completely. The mixture of the color filter material and the compressed fluid is ejected through the printhead toward the substrate. The color filter material becomes free of the compressed fluid prior to the color filter material contacting the substrate at the second predetermined location.

When forming a color filter array, the process, described above, can include the printhead ejecting a first color filter array material in a first predetermined location followed by the printhead ejecting a mixture of a second color filter material and a compressed fluid. When operated in this manner, the printhead is positioned in a second predetermined location relative to the substrate. The mixture of the second color filter material and the compressed fluid is then ejected through the printhead toward the substrate. The second color filter material becomes free of the compressed fluid prior to the second color filter material contacting the substrate at the second predetermined location. The second predetermined location can be distinct and different from the first predetermined location mentioned above. Alternatively, the second predetermined location can overlap the first predetermined location either completely or partially.

Color filter arrays find application on both capture and display devices. To be useful, these devices usually require resolutions which put practical upper limits on pixel size. Due to the small pixel size requirements of many color filter arrays (5–50 um), it is preferrable to have a correspondingly small aperture in the nozzle. Though collimation can be achieved in this size range, the nozzle is preferrably substantially similar in size when compared to the desired color filter array pixel size. In addition, as many color filter arrays are used in front of devices which are square or rectangular, unless a physical feature is patterned into the substrate to guide the particles, a similar shape of the nozzle exit to the desired color filter array pixel is preferred.

In the very small size range, though substantially collimated by the nozzle shape, it is difficult to maintain a 5–50 um spot size for an extended length of travel outside the nozzle. It is, therefore, desirable to maintain close proximity between the nozzle and the substrate (0 mm (contact) to 1 mm). An additional benefit to maintaining a close working distance is a reduction in stray particles which can reach the local area of interest. Additionally, the periphery of the printhead reduces or prevents stray particles from contaminating the substrate.

Each of the embodiments described above can be incorporated in a printing network for larger scale printing operations by adding additional printing apparatuses on to a networked supply of compressed fluid and color filter material. The network of printers can be controlled using any suitable controller. Additionally, accumulator tanks can be positioned at various locations within the network in order to maintain pressure levels throughout the network.

The invention has been described in detail with particular reference to certain preferred embodiments thereof, but it will be understood that variations and modifications can be effected within the scope of the invention.

What is claimed is:

1. A method of forming a color filter comprising:

providing a mixture of a color filter material and a compressed fluid;

providing a substrate;

providing a printhead adapted to deliver the mixture of the color filter material and the compressed fluid toward the substrate;

positioning the printhead in a predetermined location relative to the substrate; and ejecting the mixture of the color filter material and the compressed fluid through the printhead toward the substrate, wherein the color filter material becomes free of the compressed fluid prior to the color filter material contacting the substrate at the predetermined location.

2. The method according to claim 1, wherein the predetermined location is a first predetermined location, the method further comprising:

positioning the printhead in a second predetermined location relative to the substrate; and ejecting the mixture of the color filter material and the compressed fluid through the printhead toward the substrate, wherein the color filter material becomes free of the compressed fluid prior to the color filter material contacting the substrate at the second predetermined location.

3. The method according to claim 1, wherein the predetermined location is a first predetermined location and the color filter material is a first color filter material, the method further comprising:

providing a mixture of a second color filter material and a compressed fluid;

positioning the printhead in a second predetermined location relative to the substrate; and ejecting the mixture of the second color filter material and the compressed fluid through the printhead toward the substrate, wherein the second color filter material becomes free of the compressed fluid prior to the second color filter material contacting the substrate at the second predetermined location.

4. The method according to claim 3, wherein the first predetermined location is distinct from the second predetermined location.

5. The method according to claim 3, wherein the second predetermined location partially overlaps the first the first predetermined location.

6. The method according to claim 3, wherein the second predetermined location overlaps the first the first predetermined location.

7. The method according to claim 1, wherein the printhead includes at least one nozzle having a rectangular exit shape.

8. The method according to claim 1, wherein the printhead includes at least one nozzle having a square exit shape.

9. The method according to claim 1, wherein the printhead includes at least one nozzle having a side length of between 1 and 100 microns.

10. The method according to claim 1, wherein the printhead includes at least one nozzle having a side length of between 5 and 25 microns.

11. The method according to claim 1, wherein the predetermined location of the printhead is between 0 mm and 1 mm from the substrate.

12. The method according to claim 1, wherein the substrate is flexible.

13. The method according to claim 1, wherein the substrate is rigid.

14. The method according to claim 1, wherein the color filter material is selected from the group consisting of phthalocyanines, isoindolinones, isoindolines, benzimidazolones, quinophthalones, quinacridones, dioxazines, thioindigos, epindolidiones, anthanthrones, isoviolanthrones, indanthrones, imidazobenzimidazolones pyrazoloquinazolonesiketopyrrolopyrroles, and bisaminoanthrones.

* * * * *